United States Patent [19]

Mochizuki

[11] Patent Number: 4,883,041

[45] Date of Patent: Nov. 28, 1989

[54] SUPERCHARGING PRESSURE CONTROL DEVICE

[75] Inventor: Masahiro Mochizuki, Chiryu, Japan

[73] Assignee: Aisin Seiki Kabushiki Kaisha, Kariya, Japan

[21] Appl. No.: 224,327

[22] Filed: Jul. 26, 1988

[30] Foreign Application Priority Data

Jul. 31, 1987 [JP] Japan ..... 62-191917

[51] Int. Cl.[4] ..... F02D 23/00

[52] U.S. Cl. ..... 123/564

[58] Field of Search ..... 123/559.1, 564

[56] References Cited

U.S. PATENT DOCUMENTS

| | | | |
|---|---|---|---|
| 4,530,339 | 7/1985 | Oguma et al. | 123/561 |
| 4,656,992 | 4/1987 | Oonaka et al. | 123/564 X |
| 4,727,847 | 3/1988 | Takeda et al. | 123/564 |
| 4,766,873 | 8/1988 | Miyagi et al. | 123/564 X |

FOREIGN PATENT DOCUMENTS

| | | | |
|---|---|---|---|
| 197733 | 9/1986 | Japan | 123/564 |

*Primary Examiner*—Michael Koczo

*Attorney, Agent, or Firm*—Burns, Doane, Swecker & Mathis

[57] ABSTRACT

A supercharging pressure control device for an internal combustion engine provided with a supercharger includes a first intake passage interposed between the engine and the supercharger, a second intake passage interposed between a throttle valve and the supercharger, a by-pass passage interposed between first and second passages for by-passing the supercharger, a supercharging pressure control valve interposed between first and second passage for controlling the opening and closing of the by-pass passage and a control valve interposed between the first intake passage and the supercharging pressure control valve for increasing the value of the positive pressure in accordance with the increase of the RPM of the engine and the opening degree of the throttle valve. A three-way electromagnetic valve is interposed between the second intake passage and the control valve for communicating the negative pressure generated in the second intake passage or the atmosphere with the control valve in accordance with the RPM of the opening degree of the throttle valve.

3 Claims, 3 Drawing Sheets

SUPERCHARGING PRESSURE CONTROL DEVICE

BACKGROUND OF THE INVENTION

1. Field of the Invention

The present invention relates to a supercharging pressure control device and, more particularly, to a supercharging pressure control device which is utilized for a supercharging pressure control system of an engine provided with a supercharger.

2. Description of the Related Art

In a conventional engine provided with a mechanical supercharger, a quantity of air for the supercharging is increased in accordance with the increase of the number of revolutions of the engine, so that the pressure within the intake manifold is also increased in accordance with the number of revolutions of the engine. However, when a supercharging pressure is increased too much, durability of the engine is adversely effected, for example, generation of knocking, etc. occurs. Therefore, some methods have been developed for discharging the supercharging air into the atmosphere or by-passing the supercharger when the supercharging pressure exceeds a predetermined value.

FIG. 4 shows a conventional control apparatus of an engine supercharger in Japanese Laid Open Publication No. 58(1983)-101218. Therein, a supercharging control valve 44 is located upstream of a throttle valve 43 in an intake passage 42 of an engine 41. A supercharging passage 45 is formed so as to bypass the supercharging control valve 44. A supercharger 46, driven by the rotation of the engine 41, is positioned in the passage 45. The throttle valve 43 and the supercharger control valve 44 are operatively interlocked or interconnected by a linkage 47. The supercharger control valve 44 is closed in accordance with the opening actuation of the throttle valve 43. In case the supercharging pressure supplied by the supercharger 46 exceeds a predetermined supercharging pressure, the supercharging control valve 44 is opened by an actuator 48 regardless of the position of the throttle valve 43 and the supercharging pressure is maintained at a certain or predetermined value.

The conventional apparatus is operated so as to maintain the supercharging pressure at a certain or predetermined value by the actuator. However, it was not possible to decrease the supercharging pressure in the prior art apparatus in order to decrease fuel expenses.

SUMMARY OF THE INVENTION

Accordingly, an object of the present invention is to provide a supercharging pressure control device which can improve acceleration characteristics and decrease fuel expenses.

In order to achieve the above and other objects, there is provided according to the present invention a supercharger pressure control valve having first and second signal ports. The first signal port is in communication with an intake passage extending between a throttle valve and a supercharger. When the number of revolutions (RPM) of the engine is below a predetermined value or when the opening degree of the throttle is below a predetermined value, the atmosphere is supplied to the second signal port. When the number of revolutions of the engine is above a predetermined value or when the opening degree of the throttle is above a predetermined value, the second signal port is in communication with a positive pressure source in which the positive pressure value is increased in accordance with the increase of the number of revolutions of the engine.

BRIEF DESCRIPTION OF THE DRAWINGS

The above and other related objects and features of the invention will be apparent from the following description of the disclosure found in the accompanying drawings.

DESCRIPTION OF A PREFERRED EMBODIMENT

Figure 1:
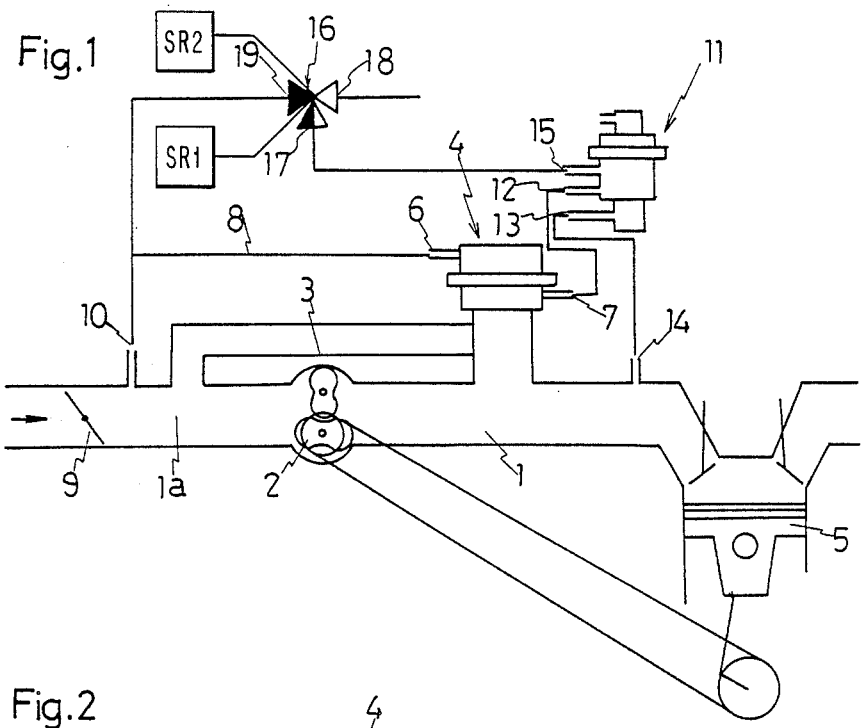
FIG. 1 is a systematic view of a preferred embodiment of a control device according to the present invention.

The invention will now be described in detail with reference to FIGS. 1 to 3, which show an embodiment of a supercharger pressure control device according to the present invention.

In the drawings, reference numeral 1 denotes a portion of an intake passage between a supercharger 2 and an engine 5 and reference numeral 3 is a by-pass passage for by-passing the supercharger 2. The quantity of by-pass air passing through the by-pass passage 3 is controlled by the degree of valve opening of a supercharging pressure control valve 4. The degree of valve opening of the supercharger pressure control valve 4 is determined by a first signal pressure from a first signal port 6, a second signal pressure from a second signal port 7, and the pressure value sensed within the intake passage portion 1. The first signal port 6 is in communication, via a pressure sensor line 8, with a pressure port 10 of a portion of the intake passage la extending between a throttle valve 9 and the supercharger 2. The second signal port 7 is connected with an outlet port 12 of a control valve 11 by a pressure transmitting passage. A positive pressure inlet port 13 of the control valve 11 is connected with a pressure port 14 of the intake passage portion 1. A signal port 15 of the control valve 11 is connected with a common port 17 of a three-way electromagnetic valve 16. The three-way electromagnetic valve 16 permits communication between the common port 17 and an atmospheric passage inlet port 18 when the degree of throttle opening is below a predetermined value or when the engine speed is below a predetermined value and to permit communication between the common port 17 and a negative pressure port 19 connected to the pressure port 10 when the degree of throttle opening and the engine speed are above their respective predetermined values. Conventional sensors SR1, SR2 are provided for sensing engine speed and the degree of throttle opening, respectively.

Figure 2:
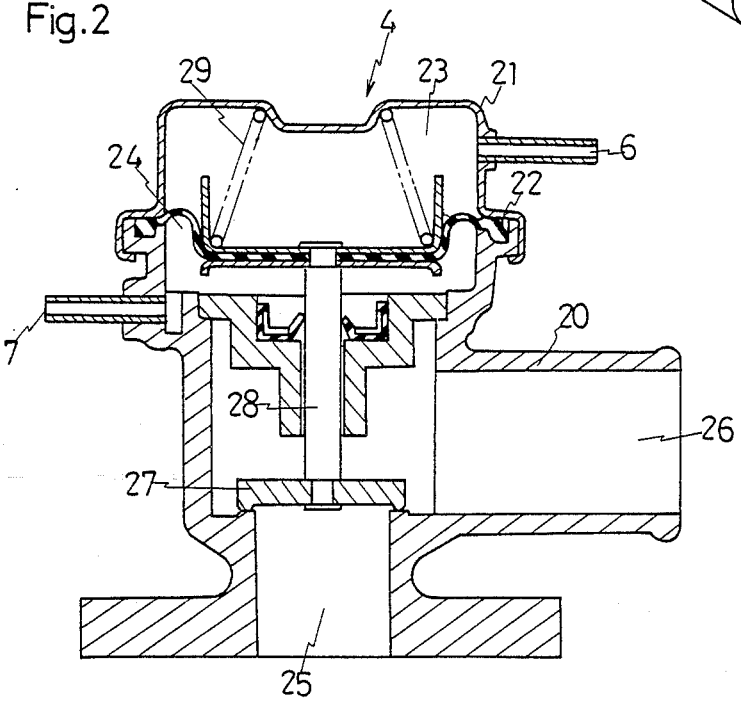
FIG. 2 is a sectional view of a supercharging pressure control valve in FIG. 1.

FIG. 2, which shows the supercharger pressure control valve 4 also shows reference numeral 20 which denotes a valve body and reference numeral 21 which denotes a valve cover. A chamber is formed by the body 20 and the cover 21 and is divided into a first signal chamber 23 and a second signal chamber 24 by a diaphragm 22. A valve 27 is fixedly connected to one end of a rod 28. The opposite end of the rod 28 is fixedly connected to the diaphragm 22, so that movement of the valve 27 is interlocked in accordance with the movement of the diaphragm 22. An inlet port 25 is in fluid communication with the intake passage portion 1. An outlet port 26 is in fluid communication with the by-pass passage 3. Whether communication is permitted between ports 25 and 26 is determined by the existence of a pressure differential between the first and second signal chambers 23, 24 and the pressure from the inlet port 25. Reference numeral 29 indicates a spring which urges the valve 27 in a direction which prevents communication between the inlet port 25 and the interior of the control valve 4.

Figure 3:
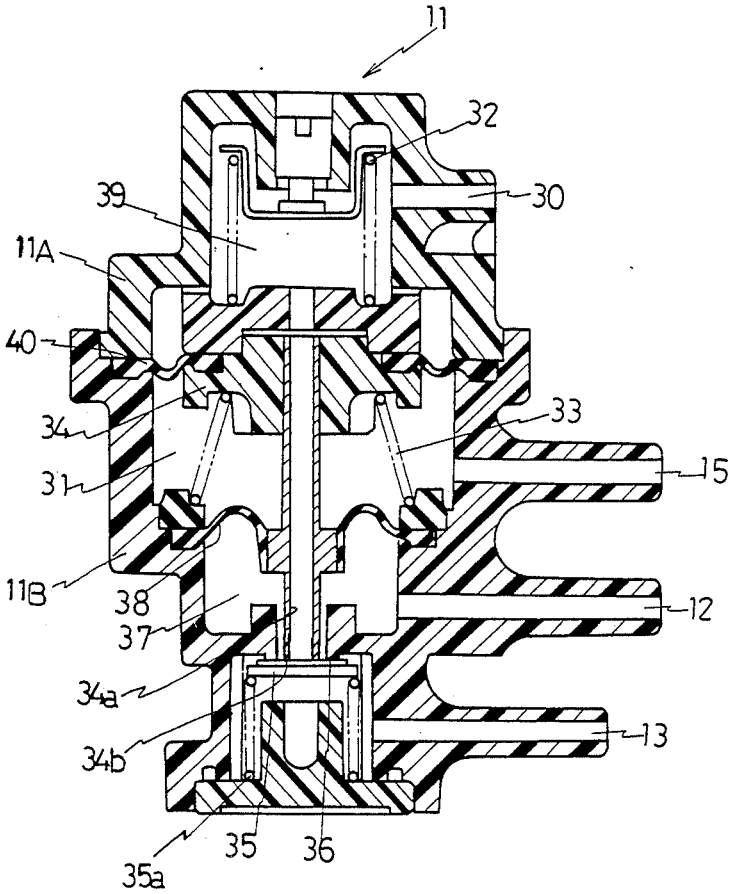
FIG. 3 is a view similar to FIG. 2, however, showing a control valve in FIG. 1.
Figure 4:
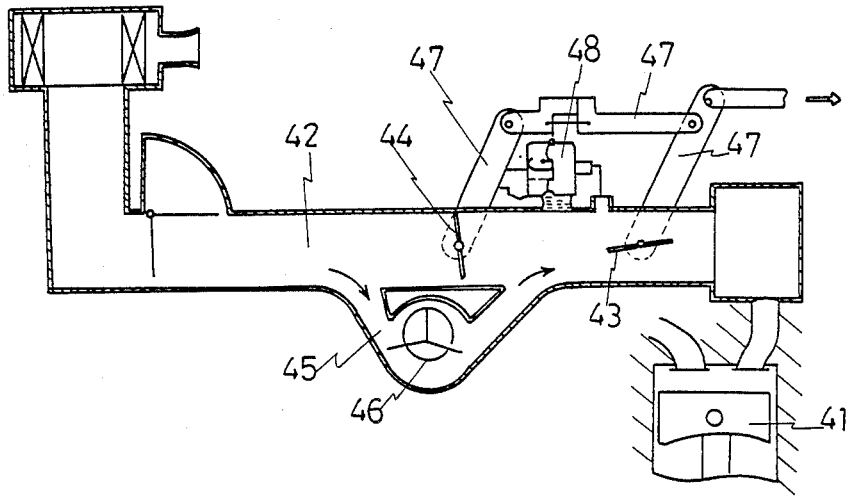
Fig. 4 PRIOR ART
FIG. 4 shows a conventional control device of an engine supercharger.

FIG. 3 shows details of the control valve 11. The control valve 11 includes a first housing section 11A and a second housing section 11B. Reference numeral 40 denotes a first diaphragm having an outer bead portion **40*a* and an inner bead portion 40*b*. The inner and outer bead portions are sealingly engaged, in an airtight manner, in the valve. The outer bead 40*a* is sealed between housing sections 11A and 11B. The inner bead 40*b* is sealed to a pressure plate 34. The pressure plate 34 has a central opening 40*c* and is provided with an extended passage portion 34*a*. The pressure plate 34 is positioned in the second housing 11B so as to be movable in an axial direction. Reference numeral 38 denotes a second diaphragm sealingly connected, in an airtight manner by an outer bead portion 38*a* to the second housing section 11B. An inner bead portion 38*b* is sealingly connected, in an airtight manner, to the pressure plate 34. The second diaphragm 38 is provided with an effective cross-sectional area which is smaller than that of the first diaphragm 40. Reference numeral 30 denotes an atmospheric inlet port formed in the first housing 11*a*** and in constant communication with atmospheric pressure.

The inlet port 30 supplies atmospheric pressure into a chamber 39 which is defined by the area bounded by the first housing 11A, the pressure plate 34 and the first diaphragm 40. The signal port 15 which communicates with the common port 17 of the three-way valve 16 is provided in the second housing section 11B. The signal port 15 is directly connected with a chamber 31 which is defined by the area bounded by the second housing 11B, the pressure plate 34, the second diaphragm 38 and the first diaphragm 40.

The outlet port 12, which is in communication with the second signal port 7 of the supercharging pressure control valve 4, is positioned in the second housing section 11B. The positive pressure inlet port 13, which is in communication with the pressure take-out port 14, is positioned in the second housing section 11B. The outlet port 12 is in direct communication with a chamber 37 defined by the area bounded by the second housing section 11B, the pressure plate 34 and the second diaphragm 38.

Reference numeral 35 denotes a movable valve which is urged or biased by a spring **35*a* so as to be in engagement with a valve seat 36 formed in the second housing section 11B and with a seat portion 34*b* formed in the end portion of the pressure plate 34 defined by the passage 34*a*. When the valve 35 is in engagement with the valve seats 34*b* and 36, communication between the positive pressure inlet port 13 and the atmosphere chamber 39 is interrupted as the passage 34*a* is closed off. A spring 32 is interposed in the atmosphere chamber 39 so as to urge the pressure plate 34 downwardly as shown in FIG. 3. A spring 33, axially displaced from spring 32, biases pressure plate 34 toward chamber 39 and spring 32**.

When atmospheric pressure is transmitted to the chamber 31 through the signal port 15, the pressure plate 34 is moved downwardly against the bias of spring 33. The downward movement of passage part **34*a* will result in movement of the movable valve 35 as the urging or biasing force of spring 32 is greater than that of the spring 33. The movable valve 35 is then released from valve seat 36. As a result, the positive pressure is transmitted from the positive pressure inlet port 13 into the chamber 37. When the positive pressure is transmitted into the chamber 37, the pressure plate 34 is biased upwardly by the diaphragm 38 and its connection at inner bead 38*b* to the pressure plate 34. The movable valve 35 is then moved upwardly to contact the valve seat 36. When the pressure plate 34 is further displaced upwardly, the air from the atmosphere inlet port 30 is transmitted into the chamber 37, so that the positive pressure within the chamber 37 is decreased. This is permitted as the passage port 34*a*, provided with seat 34*b* is not in contact with movable valve 35. As a result, the pressure plate 34 is depressed downwardly against the urging or biasing force of the spring 33 and contacts the movable valve 35. A positive pressure, corresponding to the difference of the urging or biasing force of springs 32 and 33, is maintained in the chamber 37 at the state in which communication is blocked between the positive pressure inlet port 13 and chamber 37 and between the positive pressure inlet port 13 and an air chamber 39**.

Accordingly, when atmospheric or ambient air is transmitted to the chamber 31 through the signal port 15, i.e., when negative pressure is not transmitted to the chamber 31, the outlet positive pressure P generated in outlet port 12 is theoretically expressed by the following formula:

$$P(\mathrm{kg/cm^2}) = \frac{F_1 - F_2}{S_2}$$

where $F_1$ is the urging force of the spring 32, $F_2$ is the urging force of the spring 33 and $S_2$ is the effective cross-sectional area of the second diaphragm 38.

When negative pressure, transmitted to the chamber 31 through the signal port 15, causes an increase in the $\Delta V$, a downward force Q is generated in the first diaphragm 40. This force is expressed by the following theoretical formula.

$$Q(\mathrm{kg}) = \frac{V(\mathrm{mm/Hg})}{760} \times S_1$$

Where $S_1$ is effective cross-sectional area of the first diaphragm 40.

Accordingly, the pressure plate 34 is moved downwardly against the urging or biasing force of the spring 33 and the movable valve 35 separates from the valve seat 36 while maintaining engagement with the seat portion **34*b***.

As a result, the positive pressure is transmitted to the chamber 37 and then through the outlet part 12 This permits an increase in the positive pressure in the chamber 31 with the increase of the positive pressure in the chamber 37 by an amount $\Delta P$, the pressure plate 34 being returned by the pressure differential acting on the second diaphragm 38. This permits the movable valve 35 to again contact the valve seat 36 so that the communication between the positive pressure port 13 and the outlet port 12 is interrupted. The above increase ($\Delta P$) of the positive pressure in the chamber 37 is expressed by the following formula.

$$\Delta P = \Delta V \cdot \frac{S1}{S2} \text{ (kg/cm}^2\text{)}$$

Accordingly, the positive pressure which is S1/S2 (>1) times as much as the negative pressure transmitted to the signal part 15 is generated in the outlet port 12.

In operation, when the degree of throttle opening is below a predetermined value or when the engine RPM is below a predetermined value, the electromagnetic valve 16 is not actuated and the common port 17 and the air port 18 are in communication. This permits the atmosphere to be transmitted to the second signal port 7 of the supercharging pressure control valve 4 via the outlet port 12. Thus, the degree of the valve opening of the supercharging pressure control valve 4 is determined by the pressure within the intake manifold, intake passage portion 1*a* and the intake passage portion 1. In the low load state, such as idling and during speed reduction, the negative pressure within the intake passage portion 1*a* is increased, so that more negative pressure is transmitted to the first signal port 6 of the supercharging pressure control valve 4. As a result, the diaphragm 22 of the valve 4 is pulled up against the urging or biasing force of the spring 29 and the by-pass passage 3 is fully opened so as to prevent an increase of the intake temperature. In the middle load state of engine operation for requiring supercharging pressure to a predetermined degree, the flow quantity for the by-pass is determined by the balance of the negative pressure portion within the intake passage 1*a* and the supercharging pressure within the intake passage portion 1 received by the valve 27.

Next, when the degree of throttle opening is above a predetermined value and the number of revolutions of the engine (RPM) 5 is increased but still below its respective predetermined value, the air is maintained in the second signal chamber 24 until the number of revolutions of the engine 5 reaches the predetermined value. The negative pressure within the intake passage portion 1*a* is not increased so as to overcome the bias of the spring 29 for an extended range of the degree of opening of the throttle. This permits the valve 27 to be retained at the valve closing position. The supercharging pressure is increased in accordance with the number of revolutions of the engine 5, so that an increased output is obtained. Further, when the number of revolutions of the engine 5 reaches the predetermined value, the electromagnetic valve 16 is changed over and the negative pressure port 19 and the common port 17 are placed in communication. When the opening degree of the throttle valve 9 is large, the negative pressure within the intake passage portion 1*a* is small, however, this negative pressure is increased in accordance with the increase of the number of revolutions of the engine 5. The small change of the negative pressure within the intake passage portion 1*a* results in a large change of the positive pressure by the control valve 11. This change is transmitted to the second signal port 7 of the supercharging pressure control valve 4, so that the degree of the valve opening of the supercharging pressure control valve 4 is increased in accordance with the number of revolutions of the engine 5 above the predetermined number of revolutions of the engine. Accordingly, the supercharging pressure is decreased and the fuel expenses are decreased.

To reiterate, while the degree of opening of the throttle is above its respective predetermined value and engine speed in increasing, supercharging pressure is increased, until the number of revolutions of the engine 5 reaches a predetermined value, thereby improving the acceleration characteristics, and when the number of revolutions of the engine 5 exceeds a predetermined value, the supercharging pressure is gradually decreased in accordance with the increase of the number of revolutions of the engine, thereby decreasing fuel expenses in accordance with the present invention.

It will be appreciated from the foregoing that the sensing devices SR1, SR2, the electromagnetic valve 16, and the control valve 11 together constitute a main control mechanism for controlling the supercharging pressure control valve 4, and that the electromagnetic valve 16 and the control valve 11 together constitute actuating components of the main control mechanism for interconnecting the sensing devices and the supercharging pressure control valve 4.

Further, while the second signal port 7 could be arranged to always be open to the atmosphere and the pressure upstream of the supercharger 2 transmitted to the first signal port 6 downstream of the throttle valve 9. This arrangement would operate when the engine RPM is above the predetermined value of the number of revolutions of the engine 5 and also above the predetermined value of the degree of opening of the throttle so that the quantity of the bypass is increased by the change of the negative pressure according to the increase in the number of revolutions of the engine 5. However, the change of the negative pressure is extremely small. This would result in the drawback that the diaphragm 22 would be very large for detecting the minute pressure.

The present invention overcomes the drawback of a small change of the negative pressure being amplified to a big change of the positive pressure. As many apparently widely different embodiments of the present invention can be made without departing from the spirit and scope thereof, it is to be understood that the invention is not limited to the specific embodiments thereof except as defined in the appended claims.

What is claimed is:

1. A supercharging pressure control apparatus for an internal combustion engine comprising:
   - an intake passage communicating with said engine,
   - a supercharger disposed in said intake passage,
   - a throttle valve disposed in said intake passage upstream of said supercharger,
   - a by-pass passage for by-passing said supercharger, said by-pass passage having an entrance communicating with said intake passage at a location between said throttle valve and said supercharger, and an exit communicating with said intake passage downstream of said supercharger,
   - supercharging pressure control means disposed in said by-pass passage for controlling the opening and closing thereof, and
   - main control means operably connected to said supercharging pressure control means for controlling said supercharging pressure control means, said main control means including:
     - sensing means for sensing engine speed and a degree of opening of said throttle valve, and actuating means operably interconnecting said sensing means and said supercharging pressure control means to:

selectively close and open said by-pass passage in response to the pressure difference between the pressure in said intake passage upstream of said supercharger on the one hand, and on the other hand, either atmospheric pressure or the pressure in said intake passage downstream of said supercharger, when the engine speed is below a first predetermined value or when the degree of opening of said throttle valve is below a second predetermined value, and open said by-pass passage in accordance with engine speed when the engine speed is above said first predetermined value and when the degree of opening of said throttle valve is above said second predetermined value.

2. Apparatus according to claim 1, wherein said supercharging pressure control means comprises a first valve having a first signal port communicating with said intake passage at a location between said throttle valve and said supercharger for receiving a first signal pressure therefrom, a second signal port arranged to receive a second signal pressure, and means for placing said first and second signal pressures from said first and second signal ports in mutual opposition for controlling the opening and closing of said by-pass passage; said actuating means including a second valve for supplying said second signal pressure to said second signal port.

3. Apparatus according to claim 2, wherein said second valve includes an outlet communicating with said second signal port, an inlet communicating with said intake passage at a location between said engine and said supercharger, and movable means for selectively communicating said inlet with said outlet, said actuating means further comprising a third valve for selectively communicating said movable means with atmospheric pressure or with negative pressure from a location in said intake passage between said throttle valve and said supercharger, for controlling said movable means; said third valve being controlled by said sensing means for selectively communicating said movable means with said atmospheric and negative pressures.

* * * * *